US012168987B2

(12) United States Patent
Tipton et al.

(10) Patent No.: US 12,168,987 B2
(45) Date of Patent: Dec. 17, 2024

(54) LOW PRESSURE MOLTEN METAL TRANSFER PUMP

(71) Applicant: PYROTEK, INC, Spokane, WA (US)

(72) Inventors: Jon Tipton, Aurora, OH (US); Andrew Horsfall, Aurora, OH (US); Jason Tetkoskie, Aurora, OH (US)

(73) Assignee: Pyrotek, Inc., Spokane, WA (US)

( * ) Notice: Subject to any disclaimer, the term of this patent is extended or adjusted under 35 U.S.C. 154(b) by 0 days.

(21) Appl. No.: 18/030,461

(22) PCT Filed: Sep. 28, 2021

(86) PCT No.: PCT/US2021/052403
§ 371 (c)(1),
(2) Date: Apr. 5, 2023

(87) PCT Pub. No.: WO2022/076202
PCT Pub. Date: Apr. 14, 2022

(65) Prior Publication Data

US 2023/0383754 A1 Nov. 30, 2023

Related U.S. Application Data

(60) Provisional application No. 63/087,685, filed on Oct. 5, 2020.

(51) Int. Cl.
*F04D 7/06* (2006.01)
*F04D 29/18* (2006.01)
*F04D 29/70* (2006.01)

(52) U.S. Cl.
CPC ..... *F04D 7/065* (2013.01); *F04D 29/18* (2013.01); *F04D 29/708* (2013.01)

(58) Field of Classification Search
CPC . F04D 7/065; F04D 29/18; F04D 7/06; C21C 1/06
See application file for complete search history.

(56) References Cited

U.S. PATENT DOCUMENTS 6,497,559 B1 * 12/2002 Grant ..... F04D 7/065 266/239
8,714,914 B2 * 5/2014 Cooper ..... F04D 7/065 415/121.2

(Continued)

FOREIGN PATENT DOCUMENTS

EP 1132622 A2 9/2001
JP 2001329987 A 11/2001

OTHER PUBLICATIONS

International Search Report for PCT/US2021/052403, Mailed Jan. 14, 2022, 3 pages.

(Continued)

*Primary Examiner* — Eldon T Brockman
(74) *Attorney, Agent, or Firm* — Lippes Mathias LLP

(57) ABSTRACT

A pump for transferring molten metal is provided. The pump includes a motor, a base having an impeller chamber, a shaft connected to the motor at one end, an impeller connected to the other end of the shaft and rotatable in the impeller chamber, and a riser disposed on an upper surface of the base. The base includes a shaft opening and an outlet opening in a top surface. The riser assembly has a first open end facing the base. The first open end is dimensioned to encompass the shaft opening and the outlet opening.

16 Claims, 11 Drawing Sheets

(56) References Cited

U.S. PATENT DOCUMENTS

| | | | | |
|---|---|---|---|---|
| 2001/0000465 | A1 | 4/2001 | Thut | |
| 2012/0163959 | A1* | 6/2012 | Morando | F04D 1/14 415/206 |
| 2014/0369860 | A1 | 12/2014 | Thut | |

OTHER PUBLICATIONS

Written Opinion of the International Searching Authorty on PCT/US2021/052403, dated Jan. 13, 2022, 5 pages.

* cited by examiner

LOW PRESSURE MOLTEN METAL TRANSFER PUMP

BACKGROUND

Pumps commonly used to pump molten metal include transfer pumps. Moreover, a transfer pump can transfer molten metal out of one furnace and into another furnace, into a ladle, or into a mold, as examples.

An exemplary transfer pump is illustrated in U.S. Pat. No. 5,716,195, the disclosure of which is herein incorporated by reference. The transfer pump described in the referenced patent includes a base, a shaft receiving sleeve, and a riser. Rotation of the impeller within the base forces molten metal up the riser for delivery outside of the furnace.

A further exemplary transfer pump is illustrated in U.S. Pat. No. 9,506,346, the disclosure of which is herein incorporated by reference. The transfer pump described in the referenced patent operates by rotation of an impeller/shaft assembly within an elongated tube. The impeller rotation results is a vortex of molten metal within the elongated tube that rises therein for discharge at a top end.

The present disclosure is directed to a molten metal transfer pump that advantageously provides a low-pressure discharge of molten metal using few but robust pump components. Low-pressure discharge can reduce dross formation.

BRIEF DESCRIPTION

Various details of the present disclosure are hereinafter summarized to provide a basic understanding. This summary is not an extensive overview of the disclosure and is neither intended to identify certain elements of the disclosure, nor to delineate scope thereof. Rather, the primary purpose of this summary is to present some concepts of the disclosure in a simplified form prior to the more detailed description that is presented hereinafter.

According to a first embodiment, a pump for transferring molten metal is provided. The pump includes a motor, a base having an impeller chamber, a shaft connected to the motor at one end and impeller connected to the other end of the shaft. The shaft rotates the impeller within the impeller chamber. A riser is disposed on an upper surface of the base. The riser assembly has a first open end facing the base. The base includes a shaft opening and an outlet opening in the upper surface. The first open end of the riser is dimensioned to encompass the shaft opening and the outlet opening.

According to another embodiment, a molten metal pump is provided. The pump includes an elongated tube having a bottom end and a top end. The bottom end is disposed on an upper surface of a pump base. A shaft is disposed within the elongated tube and a centrifugal impeller is rotatable by the shaft. The impeller is disposed in a pumping chamber defined by the pump base. The pumping chamber has a diameter and the elongated tube has a diameter. The elongated tube diameter is greater than the pumping chamber diameter. The pump base includes a passage in the upper surface providing fluid communication between the pumping chamber and the elongated tube. The diameter of the passage is less than the diameter of the pumping chamber.

According to a further embodiment, a molten metal pump is provided. The pump includes a body defining an elongated chamber. The elongated chamber is configured to receive a shaft and impeller assembly. The body is comprised of a refractory material. The elongated chamber includes an open top through which the shaft passes and a bottom opening residing on a top surface of a base defining a pumping chamber. The impeller is disposed in the pumping chamber. The pumping chamber includes a bearing interfacing with the impeller. The base defining the pumping chamber includes a passage in an upper surface. The passage is in fluid communication with the elongated chamber and the pumping chamber. The base has a circumference and the body has a circumference, wherein the base defining the pumping chamber circumference can be slightly larger than the body, or the same circumference as the body, or smaller than the circumference of the body. In the embodiment where the base defining the pumping chamber has a smaller O.D. circumference than the I.D. of the body, the base defining the pumping chamber can be inserted within the walls of the body. Optionally, a bottom portion of the body can form a portion of the pumping chamber, such as the inlet and/or the sidewalls.

According to an additional embodiment, a method for transferring molten metal from a vessel is provided. The method comprises disposing a molten metal pump in a bath of molten metal. The pump includes a refractory material body defining an elongated chamber. The elongated chamber is configured to receive a shaft and impeller assembly through an open top and position the impeller in a base. The base defines a pumping chamber including a passage in an upper surface in fluid communication with the elongated chamber. Rotation of the impeller forces molten metal through the passage and into the elongated chamber such that the molten metal rises in the elongated chamber without creation of a substantial vortex to a level such that molten metal is selectively discharged from the pump via a discharge channel.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
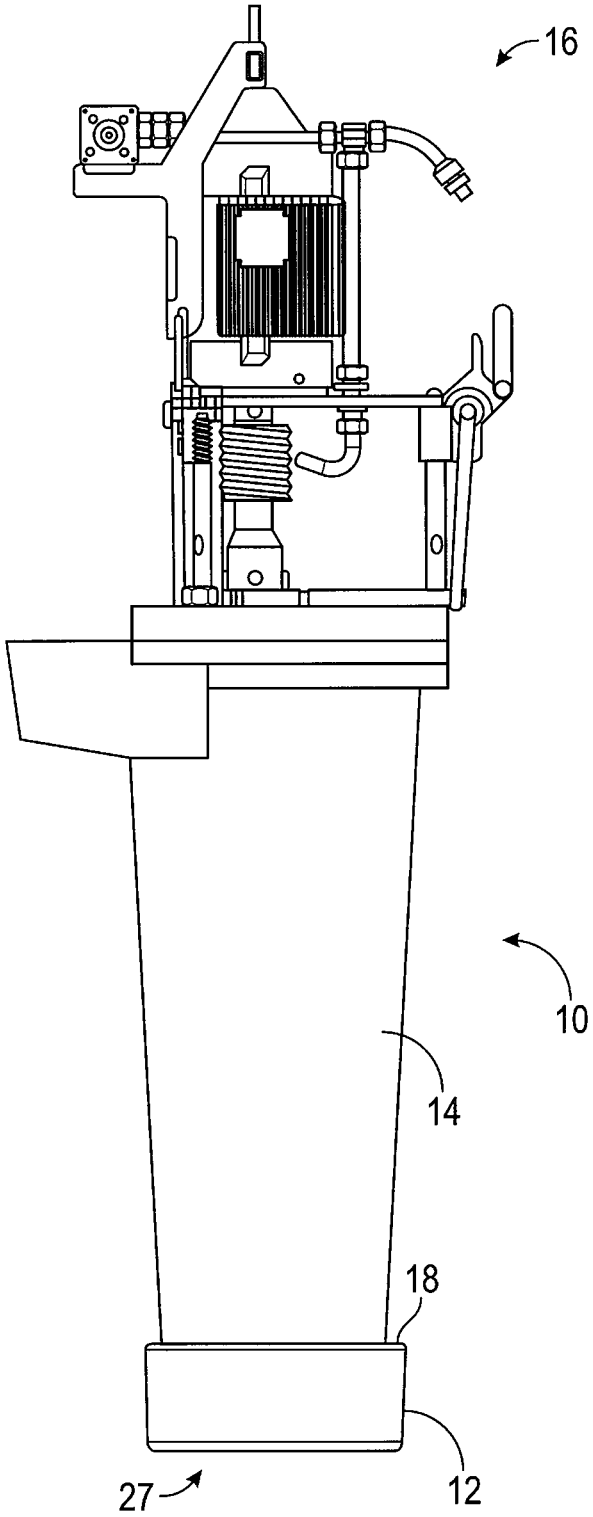
FIG. 1 is side elevation view of a first embodiment of a pump of the present disclosure.
Figure 2:
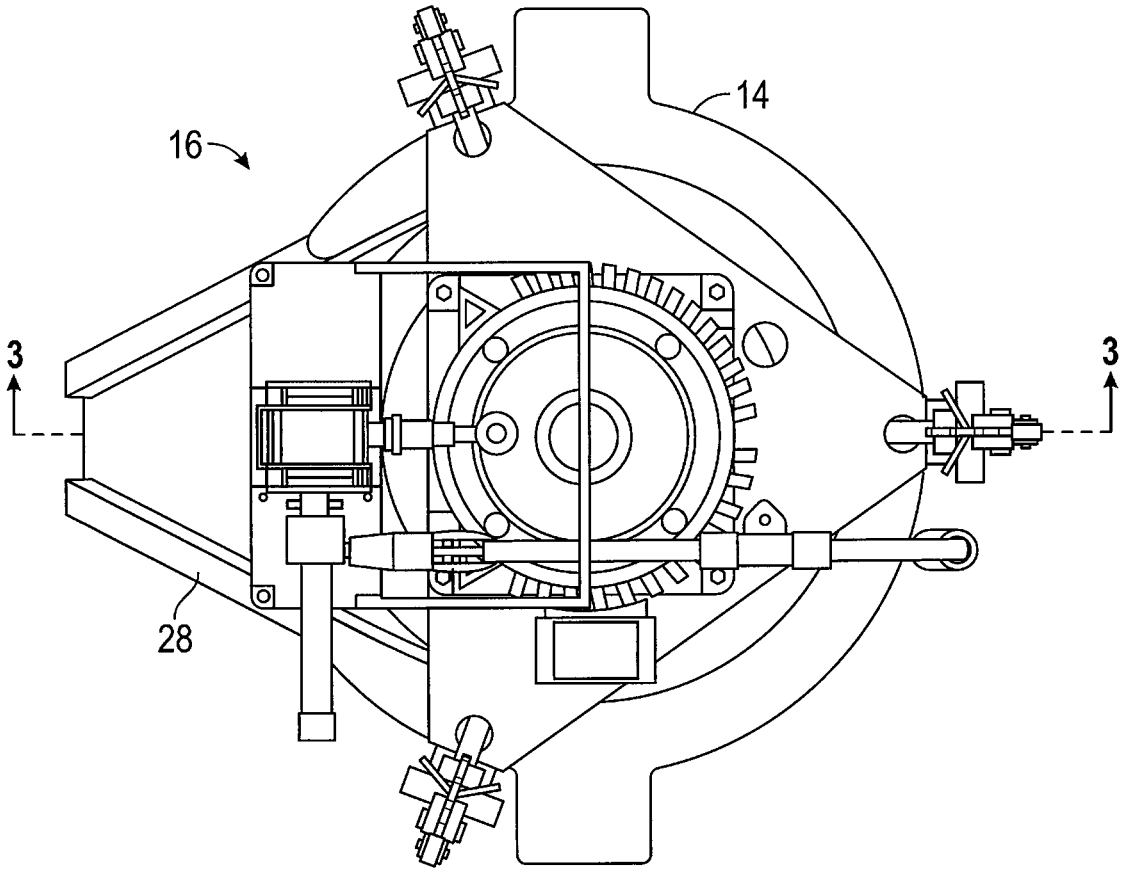
FIG. 2 is a top view of the pump of FIG. 1.
Figure 3:
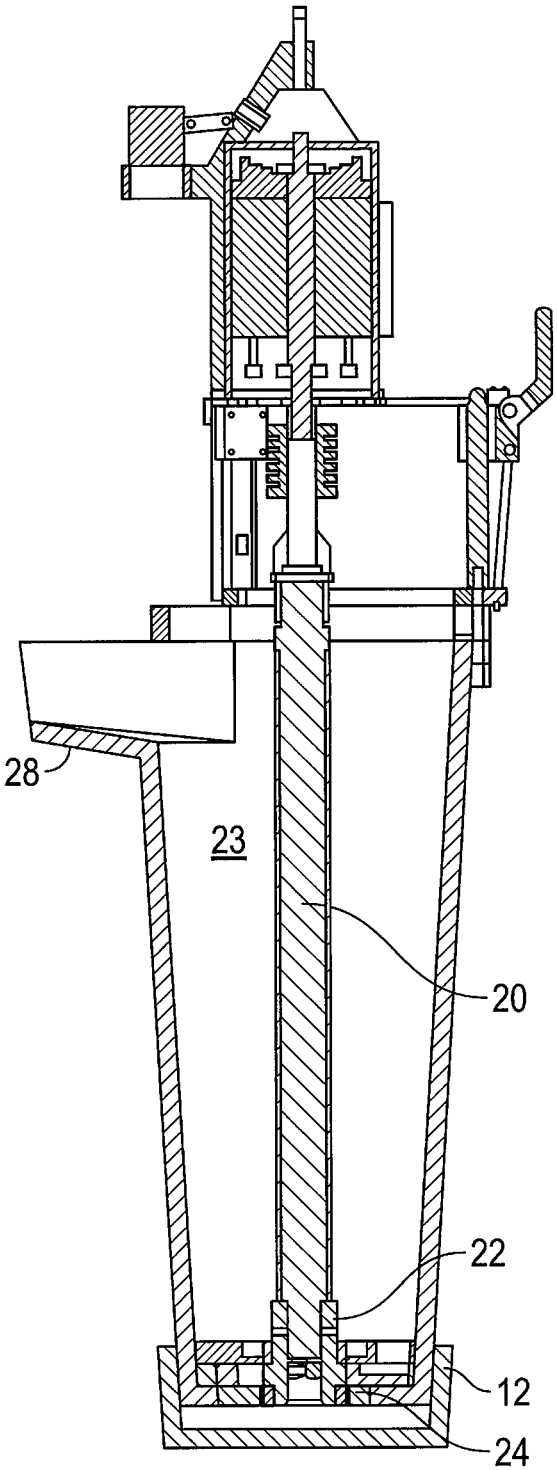
FIG. 3 is a side cross-section view of the pump of FIG. 1.
Figure 4:
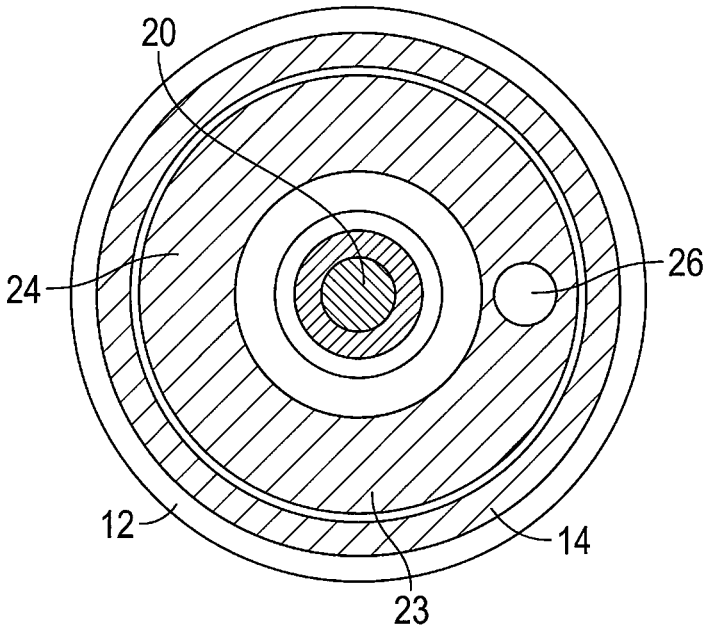
FIG. 4 is a top cross-section view of the pump of FIG. 1 taken along B-B.
Figure 5:
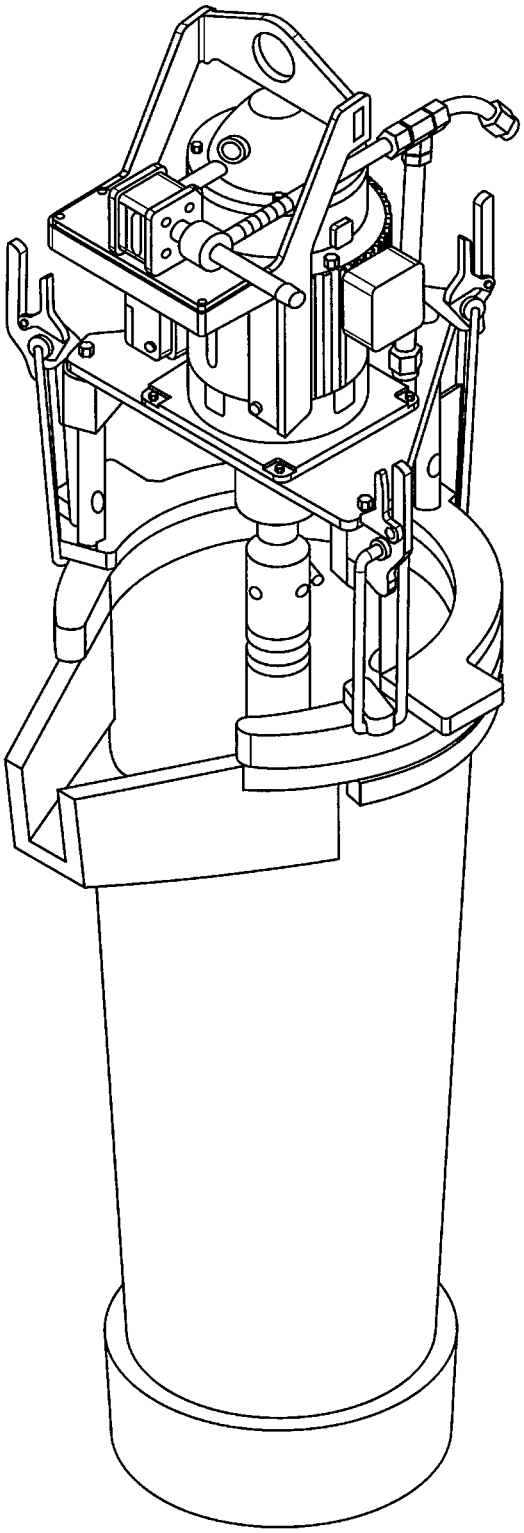
FIG. 5 is a perspective view of the pump of FIG. 1
Figure 6:
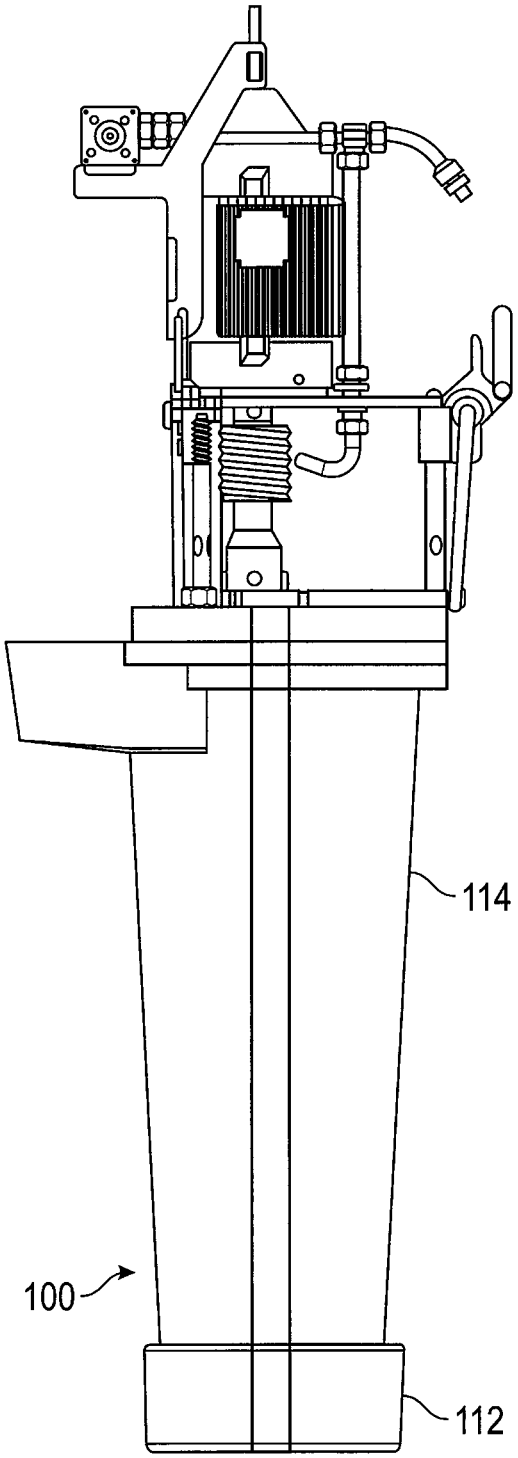
FIG. 6 is side elevation view of a second embodiment of a pump of the present disclosure.
Figure 7:
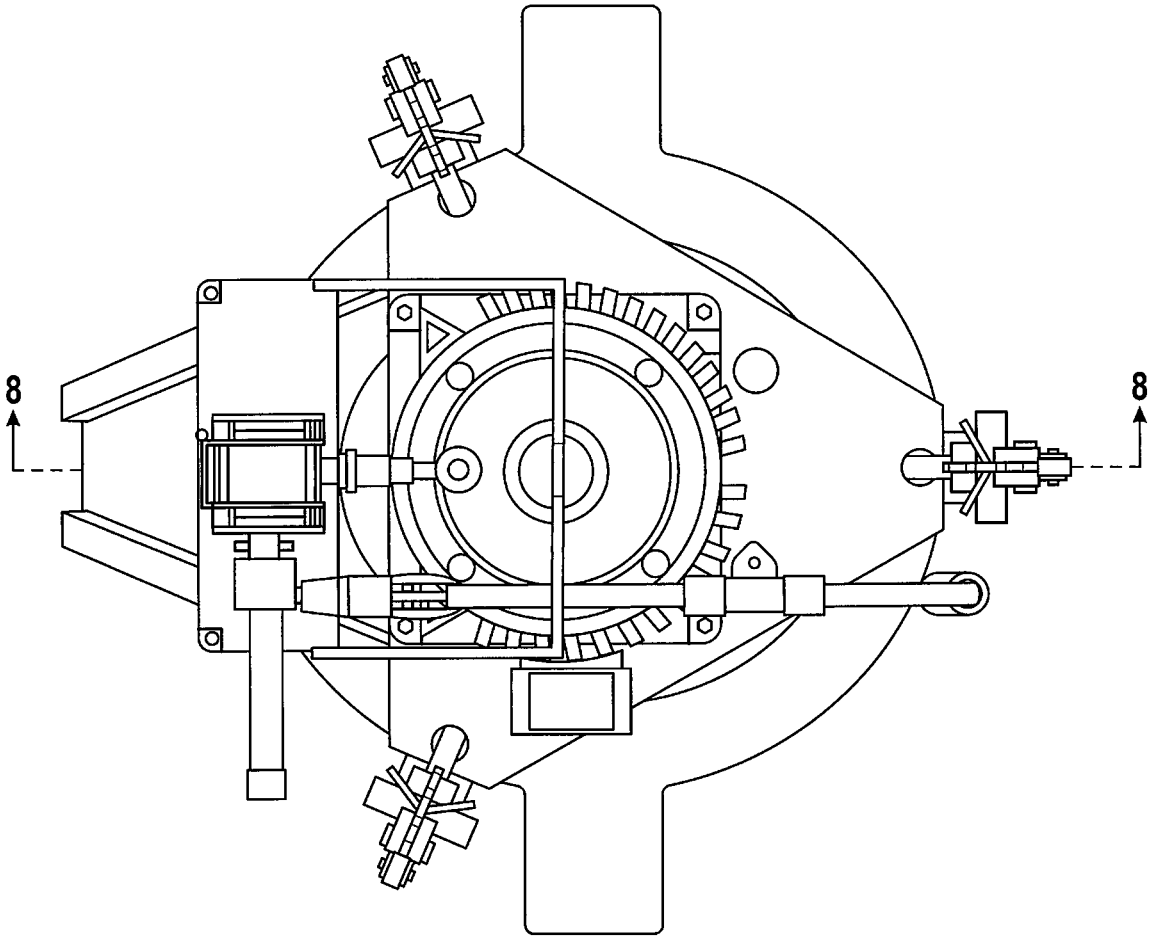
FIG. 7 is a top view of the pump of FIG. 6.
Figure 8:
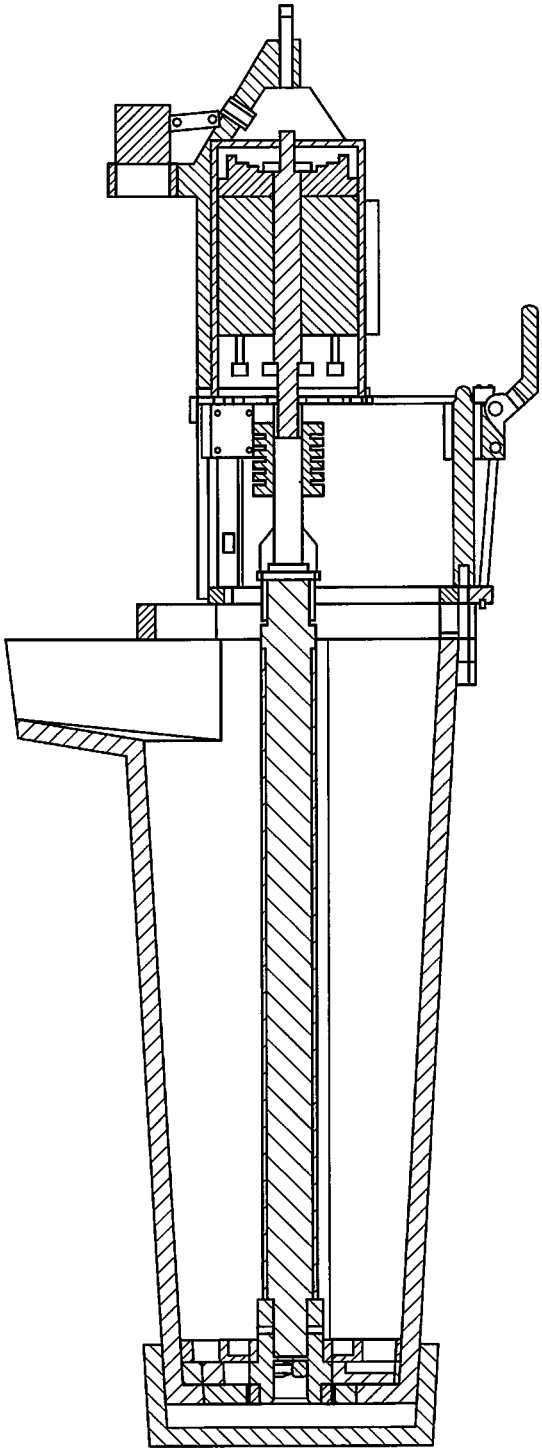
FIG. 8 is a side cross-section view of the pump of FIG. 6.
Figure 9:
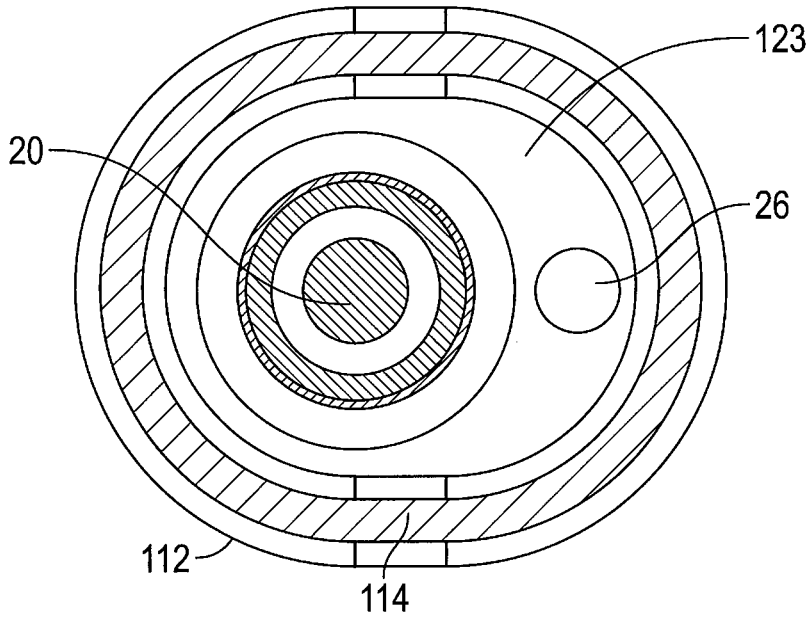
FIG. 9 is a top cross-section view of the pump of FIG. 6 taken along B-B.
Figure 10:
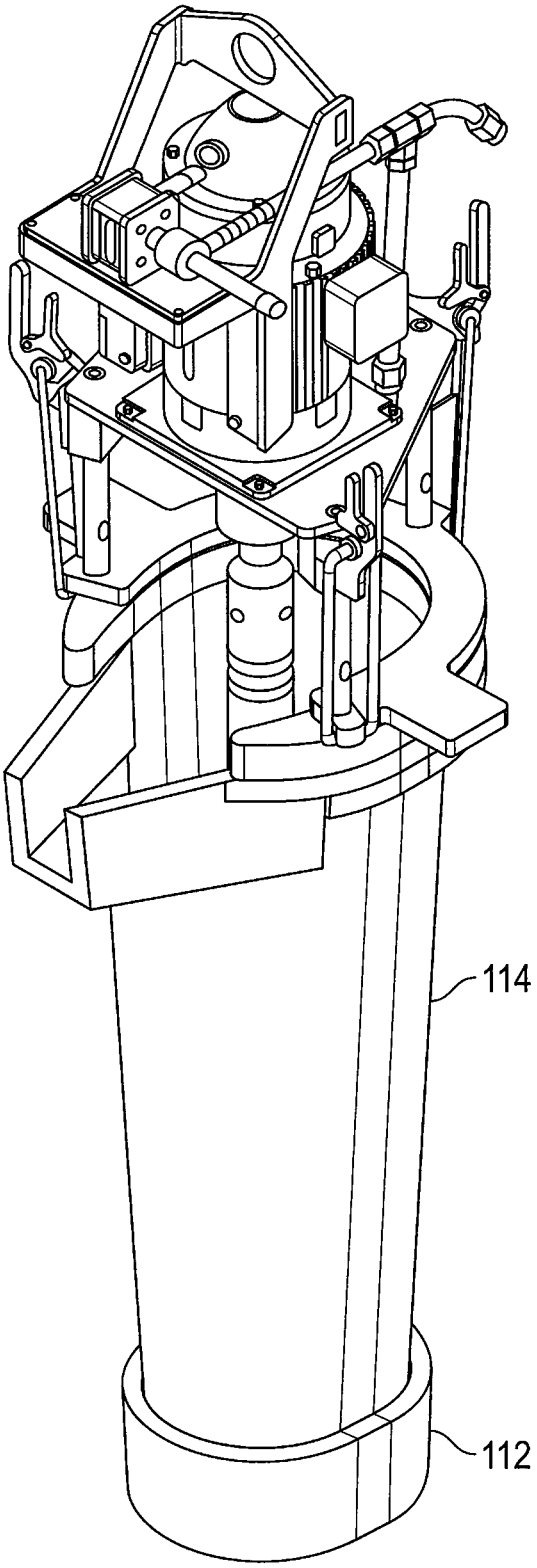
FIG. 10 is a perspective view of the pump of FIG. 6.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used herein, the terms about, generally and substantially are intended to encompass structural or numerical modifications which do not significantly affect the purpose of the element or number modified by such term.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any impurities that might result therefrom, and excludes other ingredients/steps.

With reference to FIGS. 1-5, a low-pressure transfer pump 10 is depicted. Pump 10 includes a cylindrical pumping chamber base 12, a cylindrical riser body 14, and a motor/mount assembly 16. A filter cage 18 may optionally be provided that encompasses the pump chamber base 12. The filter cage can be formed of a bonded particle material.

The pumping chamber base 12 can be formed of a graphite material. The riser body 14 can be formed of a ceramic material or of reinforced fiberglass fabric disposed in a ceramic matrix.

The riser body 14 is secured to the bonded particle filter cage 18 forming a portion of the pumping chamber base 12. The attachment can be via interference fit or cement or both.

A shaft 20 and impeller 22 assembly extends between the motor 16 and the pumping chamber base 12. Shaft 20 passes through riser chamber 23 defined by riser body 14. The impeller 22 is disposed within a pumping chamber 24 defined by the pumping chamber base 12. The pumping chamber 24 can be either a voluted chamber or a non-volute chamber. Impeller 22 is a bottom inlet configuration such that rotation of the shaft 20 and impeller 22 assembly by the motor 16 draws molten metal into the pumping chamber 24 through a bottom surface 27 with radial discharge.

Pumping chamber base 12 includes a passage 26 in top surface 30 of the pumping chamber base 12 creating fluid communication between the pumping chamber 24 and the riser chamber 23. In operation, molten metal is drawn from an external environment into the impeller 22 and radially discharged into the pumping chamber 24. The molten metal passes through passage 26 and flows into the riser chamber 23. Molten metal passing into riser chamber 23 causes a gradual rise of molten metal within the riser chamber until a controlled flow of metal enters outlet channel 28. Advantageously, the rise of molten metal in the riser chamber 23 is gentle such that vortexing and turbulence can be avoided. This allows the ingestion of potentially reactive gasses to be avoided.

It is noted that the various components including the riser body, bonded particle filter cage, and pumping chamber base can function cooperatively to form the toality of the base. For example, it is contemplated that the riser body at its lower end can form a portion of the pumping chamber side or bottom walls.

Turning now to FIGS. 6-10, an alternative pump configuration 100 is illustrated. Moreover, while the components are the same as in the first embodiment, this configuration includes an elliptical pumping chamber base 112, an elliptical riser body 114 and an elliptical riser chamber 123.

Although circular and elliptical shaped pumping chambers and riser bodies have been illustrated, it is noted that the shape of these elements is not limited. Moreover, square or rectangular shapes are also contemplated. In certain embodiments, it may be desirable that the pumping chamber base shape and the riser body shape be complimentary. It may also be desirable that the pumping chamber base be only slightly larger, or the same, or smaller in cross-sectional area than the riser at their interface.

Figure 11:
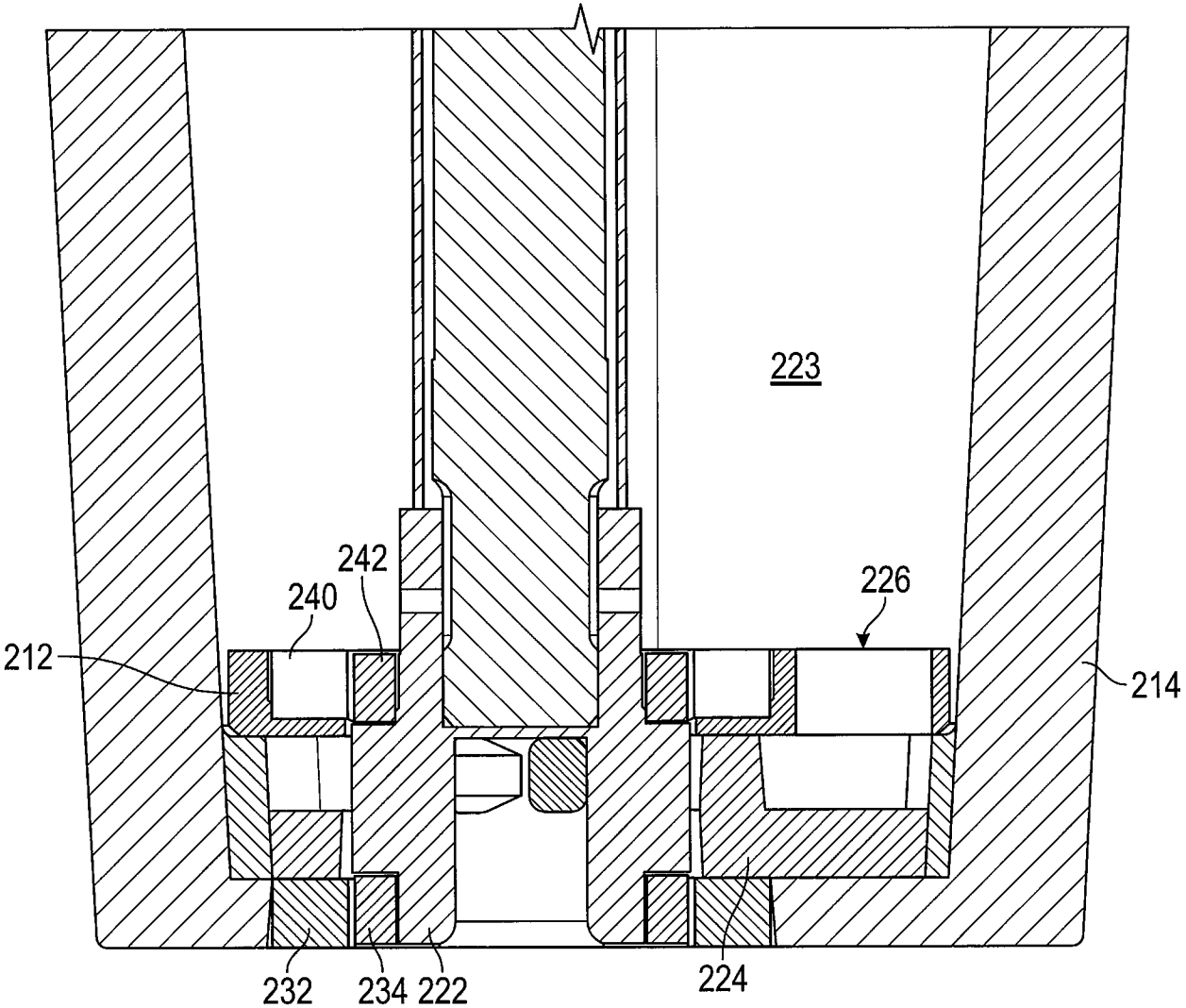
FIG. 11 is a cross-section view of an alternative configuration with respect to the mating of the pumping chamber base and the riser tube body.

With reference to FIG. 11, an alternative riser body interface with the pumping chamber base is illustrated. Particularly, riser body 214 does not terminate at an upper surface of the pumping chamber base 212. Rather riser body 214 wraps around the pumping chamber base 212 and includes bearing ring 232 that interfaces with bearing ring 234 on impeller 222. In this manner the riser body 214 effectively forms a portion of a bottom of the pumping chamber base and helps define pumping chamber 224. The upper wall of pumping chamber base 212 includes bearing 240 that interfaces with bearing 242 on impeller 222 to seal the top of pumping chamber 224. Similarly to prior embodiments, molten metal is pushed from pumping chamber 224 through passage 226 into riser chamber 223.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

To aid the Patent Office and any readers of this application and any resulting patent in interpreting the claims appended hereto, applicants do not intend any of the appended claims or claim elements to invoke 35 U.S.C. 112(f) unless the words "means for" or "step for" are explicitly used in the particular claim.

The invention claimed is:

1. A pump for pumping molten metal comprising a motor, a base defining an impeller chamber, a shaft connected to the motor at one end and an impeller at the other end, the impeller being rotatable in the impeller chamber, and a riser disposed on an upper surface of the base, said base including a shaft opening and an outlet opening in the upper surface, said riser having a first open end facing the base, said first open end being dimensioned to encompass the shaft opening and the outlet opening.

2. A molten metal pump comprising a body defining an elongated chamber, said elongated chamber configured to receive a shaft and impeller assembly, said body comprised of a refractory, ceramic or graphite material, said elongated chamber including an open top through which said shaft passes and a bottom opening interfacing with a base defining a pumping chamber, the impeller disposed in said pumping chamber, said pumping chamber including a bearing interfacing with the impeller, said base including a passage in an upper surface, said passage being in fluid communication with the elongated chamber and the pumping chamber, said base having a circumference and said body having a circumference, wherein the base circumference is only slightly larger, or the same or smaller than the circumference of the body, and wherein a circumference of a top opening of the passage is less than 20% of the circumference of the pumping chamber.

3. The molten metal pump of claim 2 wherein said passage has a longitudinal axis at least substantially parallel to a longitudinal axis of said chamber.

4. The molten metal pump of claim 2 further including a bonded particle filter cage surrounding said base.

5. The molten metal pump of claim 2 wherein the elongated chamber forms a portion of the base.

6. The molten metal pump of claim 5 wherein the portion of the elongated chamber forming the base is interposed between upper and lower sections of the base.

7. The molten metal pump of claim 6 wherein the upper and lower sections of the base are comprised of graphite.

8. The molten metal pump of claim 2 wherein said impeller includes a bottom inlet and side outlets.

9. The molten metal pump of claim 2 wherein each of said elongated chamber, said base, said pumping chamber and said passage are at least substantially cylindrical.

10. The molten metal pump of claim 2 wherein each of said elongated chamber and said base are at least substantially elliptical.

11. The molten metal pump of claim 2 wherein at least one of said elongated chamber and said base are at least substantially rectangular.

12. The molten metal pump of claim 2 wherein the bottom opening of the elongated chamber and a top opening of the passage reside in substantially the same plane.

13. A molten metal pump comprising a body defining an elongated chamber, said elongated chamber configured to receive a shaft and impeller assembly, said body comprised of a refractory, ceramic or graphite material, said elongated chamber including a top end through which said shaft passes and a bottom end defining an opening interfacing with a pumping chamber, the impeller disposed in said pumping chamber, said elongated chamber including an outlet adjacent the top end, a passage disposed between the pumping chamber and the outlet and providing fluid communication between the pumping chamber and the outlet, said pumping chamber having a circumference, said elongated chamber having a perimeter adjacent the outlet, wherein a perimeter of the passage is smaller than the perimeter of the elongated chamber and the perimeter of the pumping chamber.

14. The molten metal pump of claim 13 wherein the elongated chamber has a longitudinal axis and wherein said outlet has a longitudinal axis, and wherein the longitudinal axis of the outlet is at least substantially perpendicular to the longitudinal axis of the elongated chamber.

15. The molten metal pump of claim 13 wherein the passage provides a controlled flow of molten metal such that vortexing and turbulence can be reduced.

16. The molten metal pump of claim 15 wherein the passage is circular in cross-section.

* * * * *